US009259636B1

(12) United States Patent
Bailey

(10) Patent No.: US 9,259,636 B1
(45) Date of Patent: Feb. 16, 2016

(54) TENNIS RACQUET AIRFOIL TRAINING DEVICE

(71) Applicant: Todd M. Bailey, Golden, CO (US)

(72) Inventor: Todd M. Bailey, Golden, CO (US)

( * ) Notice: Subject to any disclaimer, the term of this patent is extended or adjusted under 35 U.S.C. 154(b) by 0 days.

(21) Appl. No.: 14/339,371

(22) Filed: Jul. 23, 2014

Related U.S. Application Data

(60) Provisional application No. 61/858,255, filed on Jul. 25, 2013.

(51) Int. Cl.
*A63B 49/00* (2015.01)
*A63B 69/38* (2006.01)

(52) U.S. Cl.
CPC ..... *A63B 69/38* (2013.01); *A63B 49/00* (2013.01); *A63B 2243/0083* (2013.01)

(58) Field of Classification Search
CPC ..... A63B 49/00; A63B 49/02; A63B 49/027; A63B 69/38; A63B 2243/0083
USPC ..... 473/459, 461, 463, 464, 546, 553, 521, 473/437, 228; D21/730, 753
See application file for complete search history.

(56) References Cited

U.S. PATENT DOCUMENTS 4,311,308 A * 1/1982 Volkl et al. ..... 473/546
4,392,650 A 7/1983 Hilton
4,971,320 A * 11/1990 Nesbit et al. ..... 473/553
5,005,833 A 4/1991 Groveman et al.
5,286,021 A * 2/1994 Shaw ..... 473/437
5,316,295 A * 5/1994 Costanzo ..... 473/521
7,445,570 B2 11/2008 Rodgers et al.
8,052,548 B1 11/2011 Stanisic et al.
D664,618 S * 7/2012 Bailey ..... D21/753
D691,227 S * 10/2013 Gates ..... D21/753
D707,315 S * 6/2014 Hall et al. ..... D21/753
2007/0275796 A1 11/2007 Carter
2010/0331125 A1* 12/2010 Enday ..... 473/463
2012/0252609 A1* 10/2012 Gates ..... 473/519

* cited by examiner

*Primary Examiner* — Raleigh W Chiu
(74) *Attorney, Agent, or Firm* — Colorado Patents

(57) ABSTRACT

A training aid for use by a player with a tennis racquet includes at least one wing having a proximal end in the throat of the racquet, and extending from that proximal end and tapering down into a distal end. A second wing may also be included, with the two wings extending in opposite directions from the throat of the racquet. When the player makes a stroke with the racquet with the aid attached, air pressure on the wings creates forces which provide the player with feedback on the position of the racquet head during the stroke. The training aid may be removably attached to the racquet, to allow the racquet to be used in normal play situations. A rotatable flap may also be provided near the distal end of at least one of the wings, so that when the flap is rotated the air pressure on the flap during a stroke is altered, thereby changing the feedback provided to the player.

8 Claims, 9 Drawing Sheets

TENNIS RACQUET AIRFOIL TRAINING DEVICE

CROSS REFERENCE TO RELATED APPLICATION

This application is a nonprovisional application claiming the benefit under 35 USC 119(e) of U.S. provisional application Ser. No. 61/858,255 filed on Jul. 25, 2013 which is incorporated herein by reference.

TECHNICAL FIELD

The present invention relates to devices and methods for training a tennis player, and more particularly to aiding in training a tennis stroke by providing feedback to the player on the position of the racquet head during the stroke.

BACKGROUND ART

Numerous attempts have been made to provide training aids for use in correcting various flaws commonly found in strokes executed by tennis players. Many of these training aids are intended to correct positions of parts of the body during the stroke, or to correct the position of the racquet relative to such body parts.

For example, U.S. Pat. No. 4,392,650 to Hilton provides a hood with blinders, plus an indicator to show the tilt of the head. The hood is intended to teach a player to keep his eyes on the ball, while the tilt indicator is provided in order to teach the player proper head position. The Hilton device may accomplish its intended goals; however, the device would be difficult to use for any tennis playing beyond simple drills. In addition, it would offer little or no feedback to the player on the position of the racquet during the stroke, which is crucial to proper execution of the stroke.

U.S. Pat. No. 5,005,833 to Groveman et al. discloses two wrist bands connected by a cord. In this way, the wrists are connected so as to prevent excessive independent action during the player's swing. This in turn forces the player to turn his shoulders when making a stroke. As with the Hilton device, it would be difficult to actually play tennis with the Groveman device. Additionally, no feedback is provided to the player on the position of the racquet during the stroke.

U.S. Pat. No. 7,445,570 to Rodgers et al. provides a band for attaching to the forearm, plus a cord connecting the band to the racquet head. This is intended to force the player's arm and wrist into a correct position relative to the racquet head during the stroke. Similarly, U.S. Pat. No. 8,052,548 to Stanisic et al., and U.S. Patent Application No. 2007/0275796 A1 to Carter both attach the arm to the racquet with a cord and band arrangement. All of these devices are designed to force the arm and wrist of the player into desired positions relative to the racquet during the stroke. However, all of the devices would be difficult to play with, and would offer little or no options as to possible positions of the arm, wrist, and racquet during a stroke.

What is therefore needed is a training aid which is uncomplicated and which allows the player to easily play tennis while using the aid. Further the training aid would ideally provide useful feedback to the player on the position of the racquet head during the stroke, so as to allow the player to learn to control the racquet head for better stroke execution. Finally, the training aid should effectively perform its intended training function over a wide variety of strokes, and thus avoid limiting the player's stroke selection.

SUMMARY OF THE INVENTION

In accordance with the present invention, a training aid for use by a player with a racquet having a handle, a throat, and a racquet head is provided. The training aid includes at least one wing having a proximal end in the throat of the racquet, and extending from the throat and tapering down into a distal end. In using the aid, the player makes a stroke with the racquet, and air pressure on the wing creates forces which provide the player with feedback on the position of the racquet head during the stroke. In this way, the player learns to feel the position of the racqet head during a stroke. Further, by adjusting the position of the racquet head in accordance with the feedback provided, the player may achieve a more optimal stroke.

Preferably, the aid includes two wings extending in opposite directions from the throat, thus enhancing the feedback to the player. As a further advantage, the aid may be removably attached to the throat, thus allowing the player to remove the aid for normal use of the racquet. Optionally, the wing or wings will be oriented in approximately the same plane as the racquet head. In practice, this orientation has been found to provide feedback on the position of the racquet head which is easily interpreted by the player. To provide adjustability, a rotatable flap may optionally be provided near the distal end of at least one of the wings, such that when the flap is rotated the air pressure on the flap during a stroke is altered, thereby changing the forces created on the flap and altering the feedback provided to said player. This allows the player to achieve a wide range of feedback with many possible strokes.

In view of the foregoing, several advantages of the present invention are readily apparent. A training aid for use by a tennis player is provided which is capable of giving the player feedback on the position of the racquet head during a tennis stroke. By adjusting to the feedback, the player learns to feel the various positions of the racquet head, and also learns to properly execute a variety of strokes. The aid is convenient to use, and may be removably mounted so as to allow the player to use the racquet in the normal manner. Finally, a rotatable flap may be provided to allow the player to achieve a wide range of feedback, with a wide selection of possible strokes.

Additional advantages of this invention will become apparent from the description which follows, taken in conjunction with the accompanying drawings.

DETAILED DESCRIPTION

Figure 1:
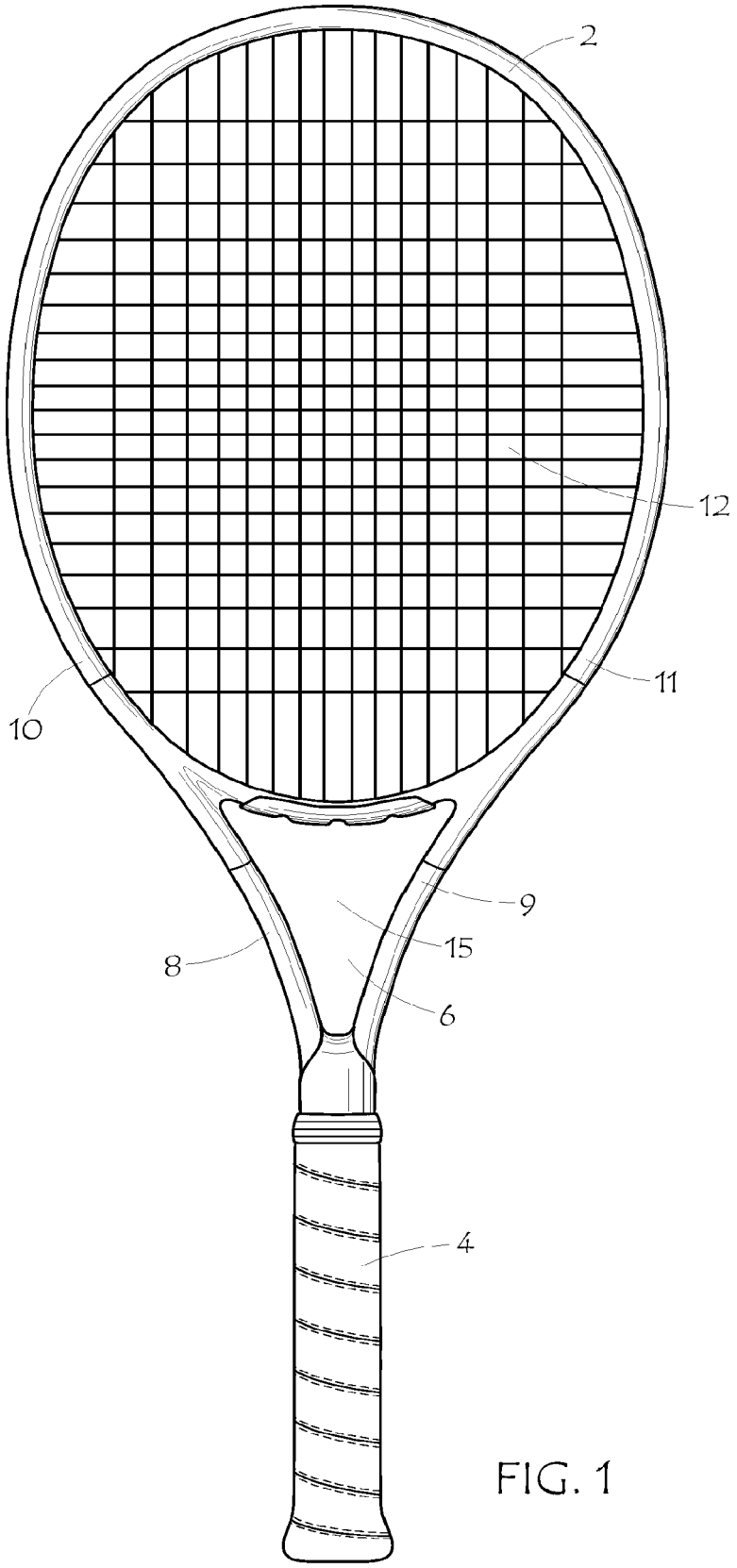
FIG. 1 is a front view of a typical tennis racquet as used with the invention.
Figure 2:
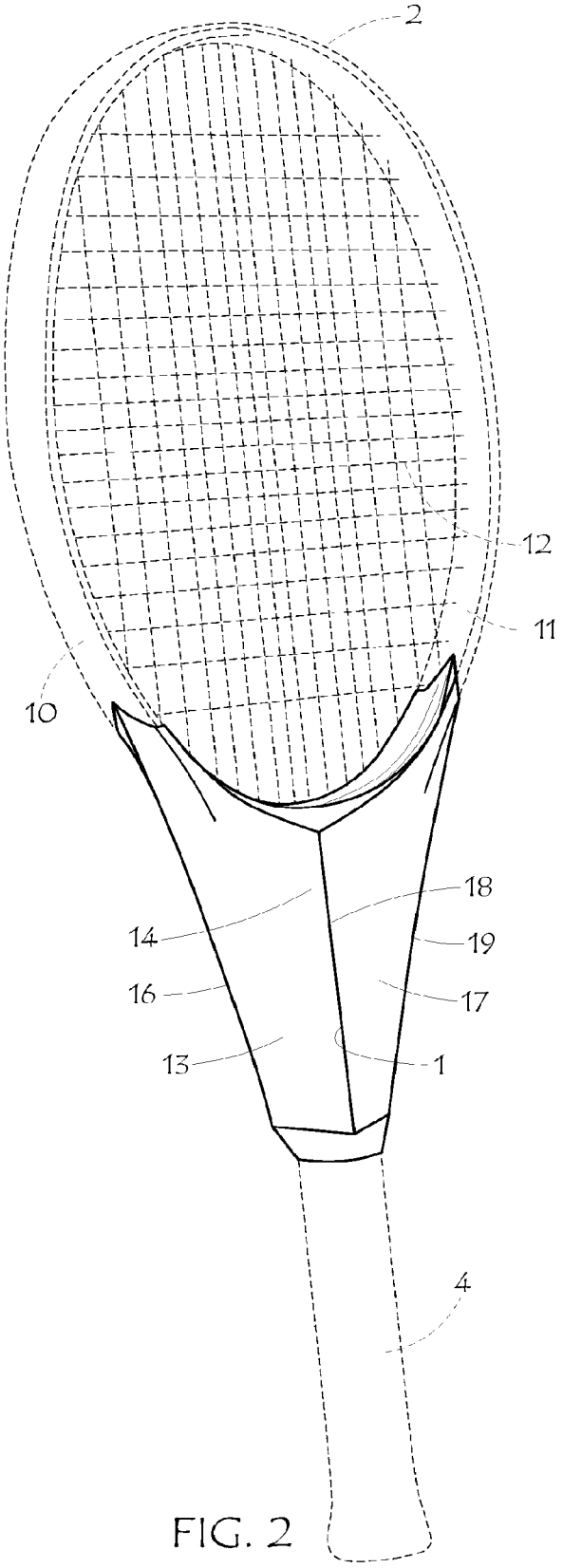
FIG. 2 is a perspective view of the air foil in place on a tennis racquet.
Figure 3:
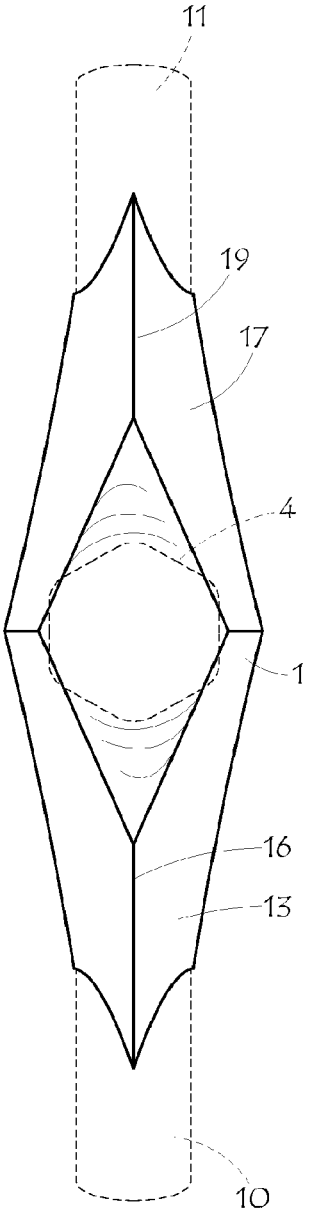
FIG. 3 is a top cross-sectional view of the air foil and racquet of FIG. 2.

Referring now to FIGS. 1-3, a tennis racquet air foil 1 is depicted in use with a tennis racquet 2. The racquet 2 includes handle 4, which is adjacent to the throat 6 of the racquet. The throat 6 has two side members 8, 9, each of which extends into a respective side 10, 11 of the racquet head 12. The air foil 1 has a first wing 13 extending laterally from a proximal end 14 near the center 15 of the throat of the racquet in approximately the same plane as that of the racquet head 12, tapering down in thickness and ideally culminating in a narrow distal end portion 16. Preferably, a like-shaped second wing 17 extends laterally from a proximal end 18 near the center 15 of the throat in the opposite direction from the first wing 13, and also culminates in a narrow distal end 19.

Figure 4:
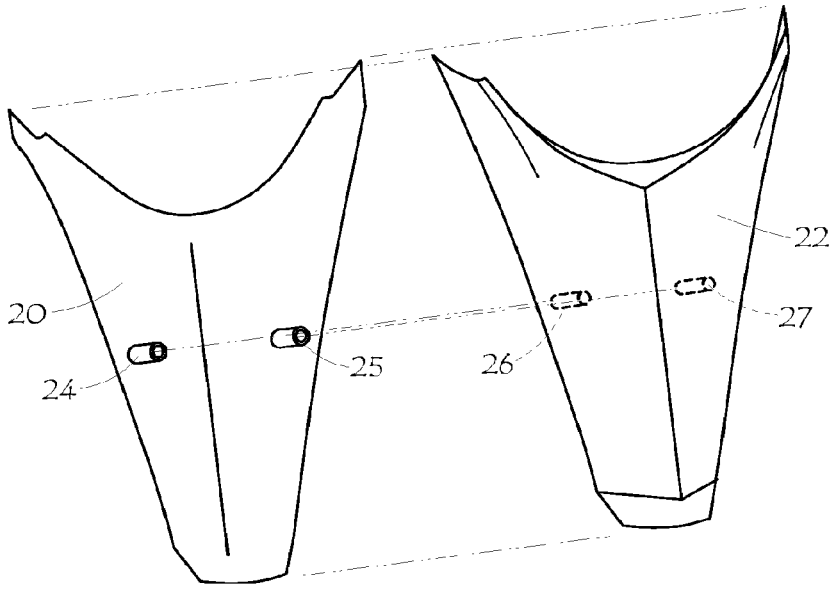
FIG. 4 is a perspective view showing two halves of the air foil and one way of removably attaching the foil to a racquet.

Referring now to FIG. 4, one advantageous embodiment of the air foil 1 is depicted. In this embodiment, the air foil 1 has two halves 20, 22 which may be snapped together to attach the air foil 1 to the racquet 2. Such attachment may be readily accomplished by pressing pins 24, 25 into corresponding receiving holes 26, 27. By reversing this operation, the two halves 20, 22 may also be readily separated, thus allowing the air foil to be removed from the racquet. Of course, any suitable attachment means could be used to removably secure the air foil to the racquet 2, including screws, clamps, bolts, velcro, or the like. The air foil could also be a permanently attached to or a part of the racquet if desired.

Figure 5:
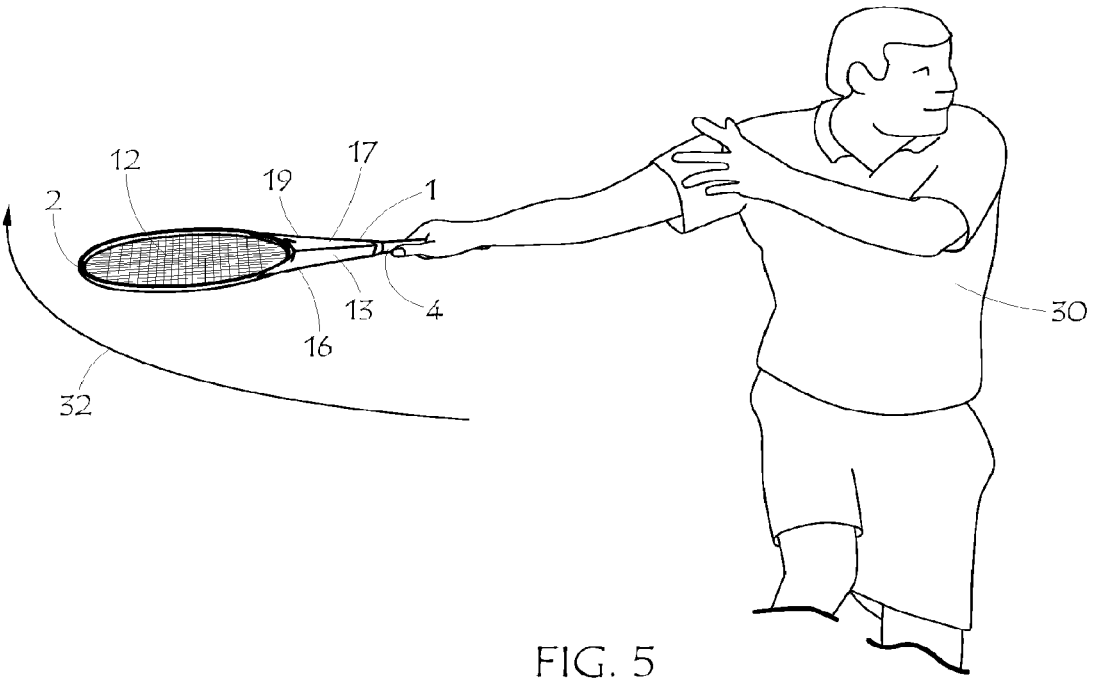
FIG. 5 is a perspective view of a player making a backswing with a racquet having the air foil in place thereon.
Figure 6:
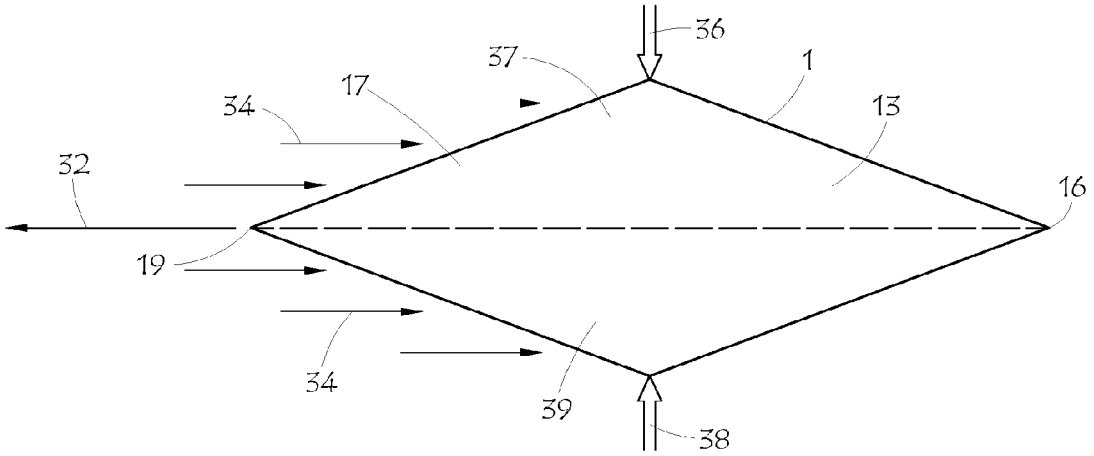
FIG. 6 is a side conceptual view of the air foil, showing air resistance and resulting forces during a stroke.

Referring now to FIGS. 5-8, the use of the air foil 1 to aid in the training of a player 30 executing the backswing portion of a forehand tennis stroke is depicted. The racquet 2 is shown in FIG. 5 with the head 12 parallel to the ground, as is commonly taught as the preferred method of making the backswing. When the backswing is executed with the racquet head parallel to the ground, the air foil 1 is positioned as shown in FIG. 6. In this orientation, the backswing path 32 is also parallel to the ground. As the air foil 1 proceeds along the path 32, air resistance 34 is exerted against the rear wing 17. Because the wing 17 is tapered to its distal end 19, the air resistance 34 impacting the wing 17 creates a downward force 36 on the upper portion 37 of the wing, and an upward force 38 on the lower portion 39 of the wing. However, since the orientation of the air foil 1 and the racquet path 32 are the same, in this case parallel to the ground, the downward force 36 and the upward force 38 are equal. Therefore, the two opposing forces cancel out, resulting in an equilibrium of forces which the player 30 can learn to feel, thus giving him useful feedback that his racquet head 12 is in the desired position. This feedback can help to train the player in making a proper backswing in his stroke.

Figure 8:
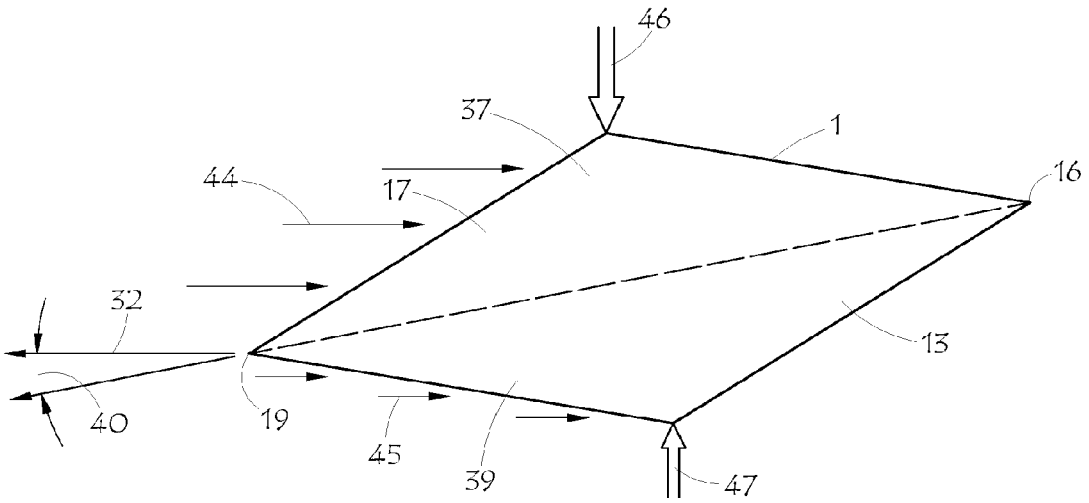
FIG. 8 is a side conceptual view of the air foil showing air resistance and resulting forces when the swing path differs from the angle of attack of the foil.
Figure 7:
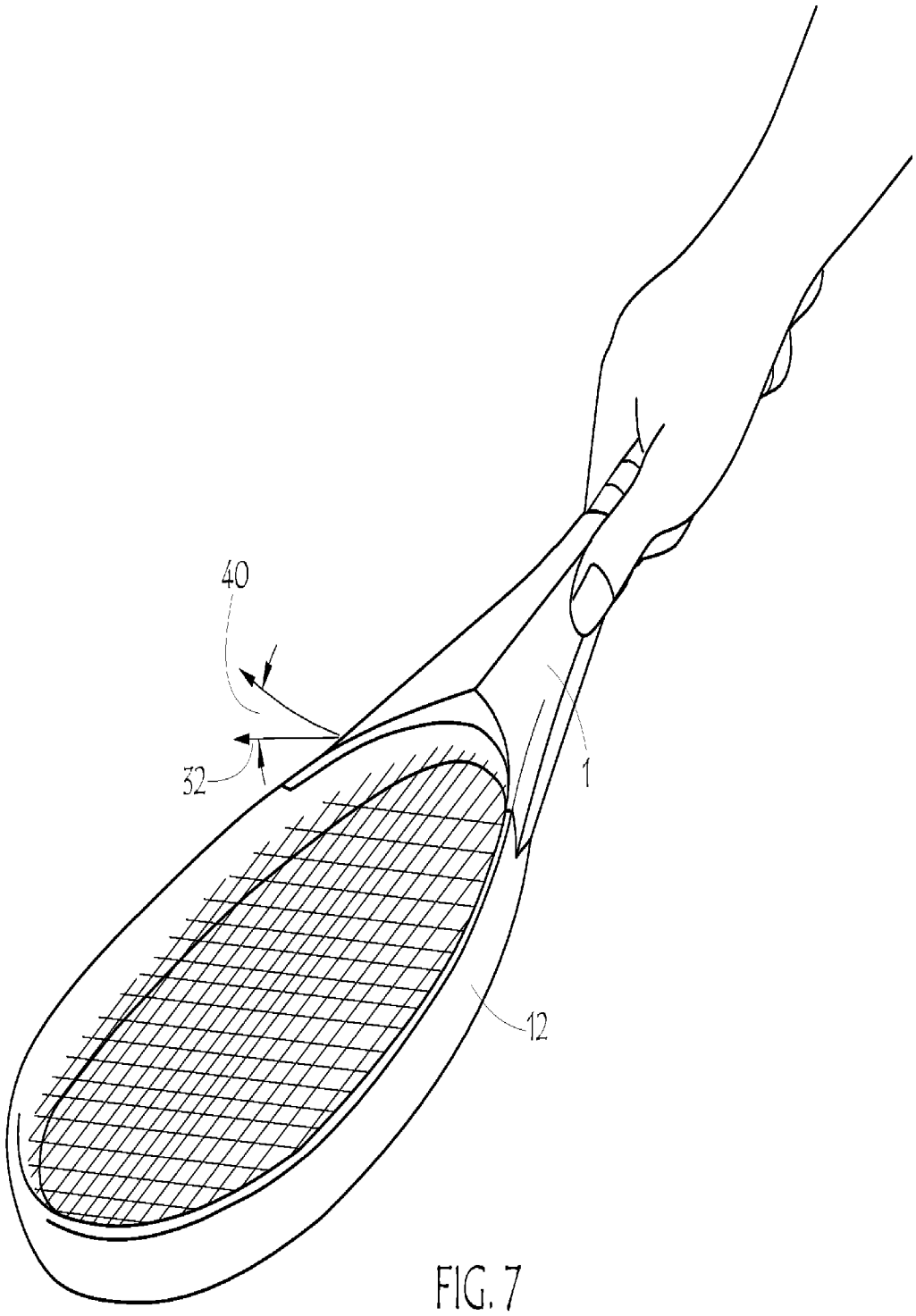
FIG. 7 is a perspective view of a racquet and air foil in a backstroke, with the swing path differing from the angle of attack of the racquet.

FIG. 7 also depicts the racquet and air foil in use in a backswing being executed, once again along path 32 parallel to the ground. However, in this orientation both the air foil 1 and the racquet head 12 are tilted at an angle 40 relative to the path 32. As shown in FIG. 8, due to this tilted orientation the air resistance 44 exerted on the wing's upper portion 37 of the foil is greater than the air resistance 45 on the lower portion 39. This imbalance of forces occurs because the tilt angle 40 (the "angle of attack") causes the upper portion 37 to more directly impact the air than the lower portion 39, which meets the air with more of a glancing blow. This tilted orientation thus results in greater air resistance 44 on the upper portion than the air resistance 45 on the lower portion.

Because the air resistance 44 on the upper portion 37 is greater than the air resistance 45 on the lower portion 39, the corresponding downward force 46 on the foil 1 is greater than the upward force 47. The player can learn to feel this imbalance in forces, and thus receives feedback that the racquet head is tilted. Further, this force differential increases as the angle of attack 40 increases, thereby allowing the player to fine-tune his sense of the relative tilt of the racquet head 12.

Figure 9:
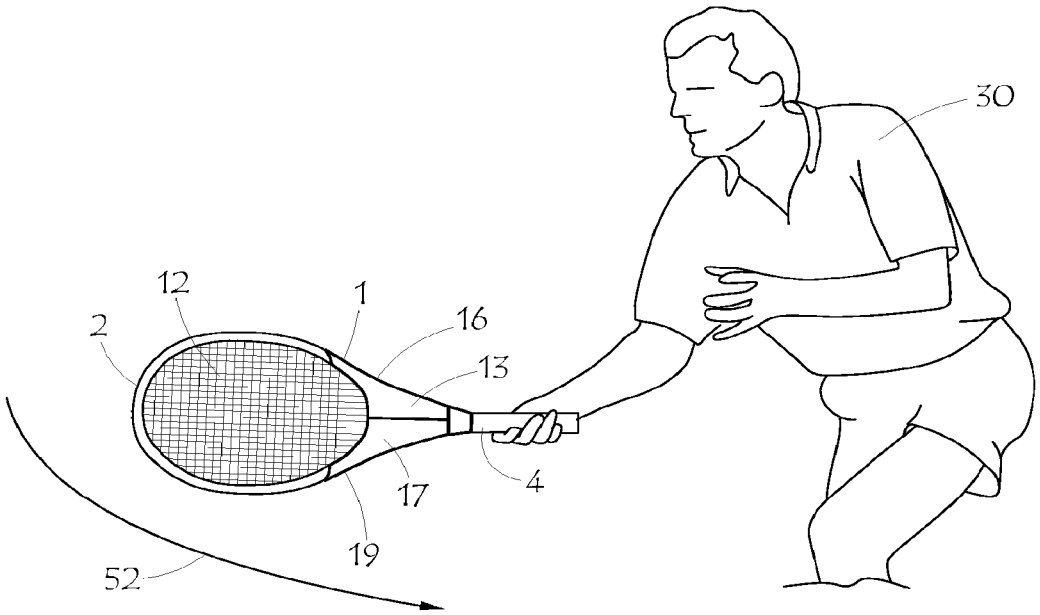
FIG. 9 is a perspective view of a player making a forehand stroke with a racquet having the air foil in place thereon.
Figure 10:
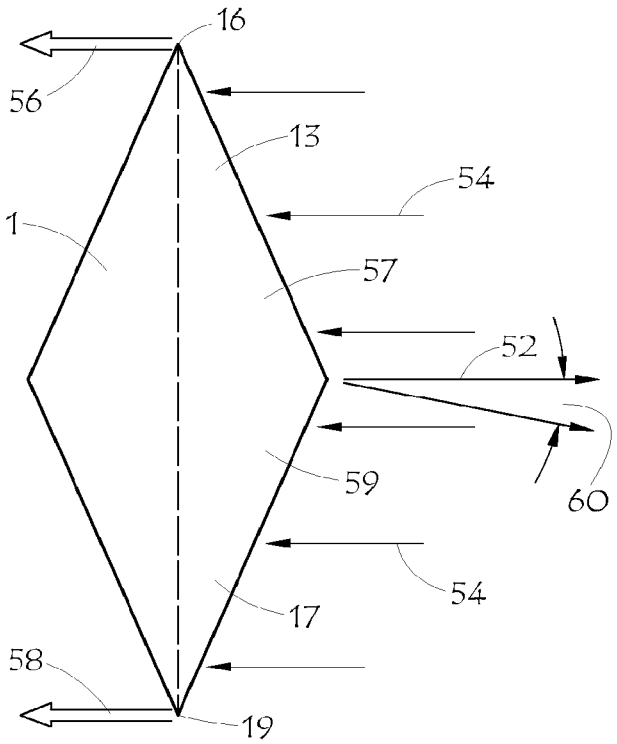
FIG. 10 is a conceptual view of the air foil of FIG. 9, showing the air resistance during the stroke and resulting forces therefrom.

Referring now to FIGS. 9-12, the player 30 is shown making the forward portion of a forehand stroke. In that portion of the forehand stroke, the racquet head 12 is ideally perpendicular to the ground, as shown in FIG. 9. FIG. 10 shows the air foil 1 also perpendicular to the ground, and perpendicular to the swing path 52. In this orientation, the air resistance 54 is equally distributed over the air foil 1. This equal distribution results in a lateral force 56 on the air foil's upper portion 57, and an equal lateral force 58 on the lower portion 59. This provides the player with useful feedback that the racquet head 12 is perpendicular to the ground.

Figure 11:
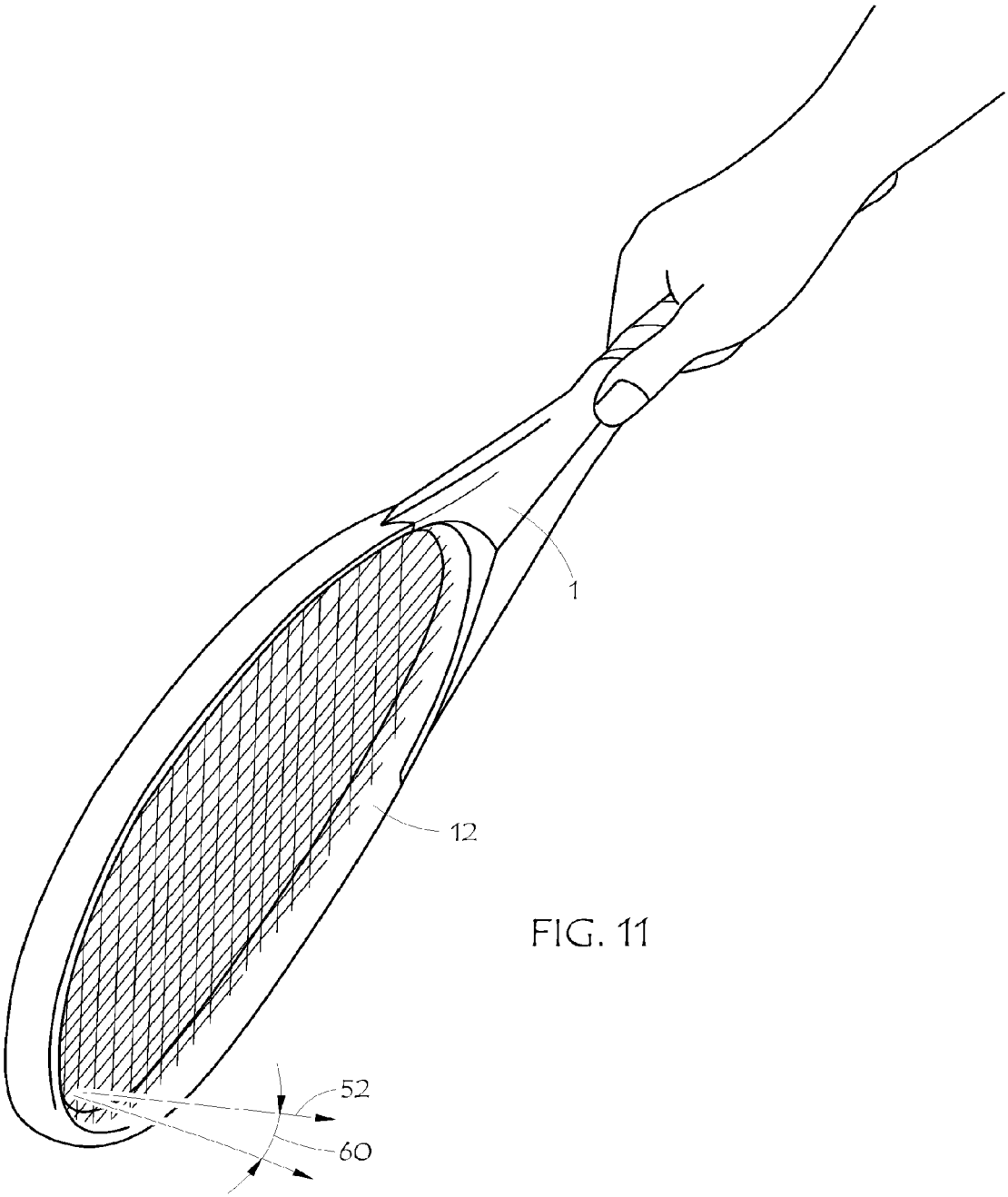
FIG. 11 is a perspective view of a racquet and air foil in a forehand stroke, with an angle of attack tilted forward from the horizontal.
Figure 12:
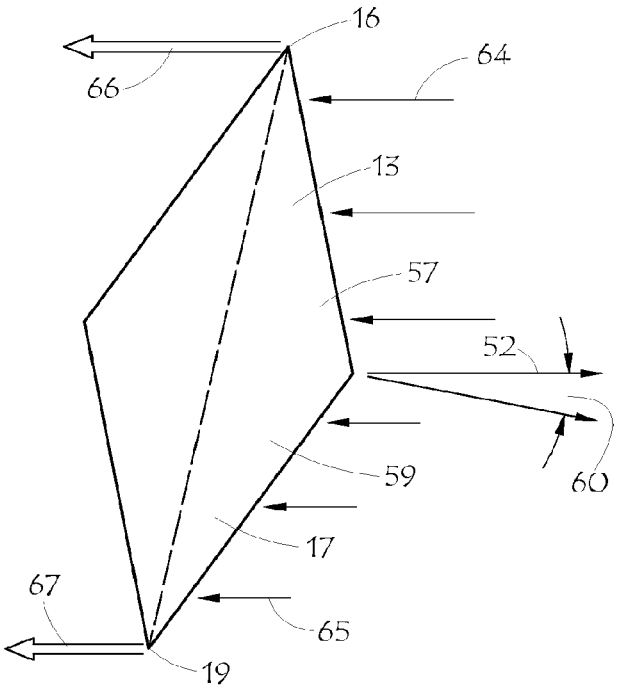
FIG. 12 is a conceptual view of the air foil of FIG. 11, showing the forces thereon when the angle of attack differs from the swing path.

FIGS. 11 and 12 depict the situation which occurs when the racquet head 12 and the air foil are tilted forward by an angle of attack 60, while still following swing path 52 parallel to the ground. In this case, the air resistance 64 on the upper portion 57 of the foil 1 is greater than the air resistance 65 on the lower portion 59. This difference in magnitude of forces occurs because the angle of attack causes the upper portion 57 to more directly impact the air than the lower portion 59, which meets the air with more of a glancing blow. This tilted orientation thus results in greater air resistance 64 on the upper portion than the air resistance 65 on the lower portion.

Because the air resistance 64 on the upper portion 57 is greater than the air resistance 65 on the lower portion 59, the corresponding rearward force 66 on the upper portion 57 of the foil 1 is greater than the rearward force 67 on the lower portion 59. Once again this gives the player valuable feedback, which is useful in training him to feel the orientation of the racquet head 12 during the stroke. As with the backswing discussed earlier, this force differential increases as the angle of attack 60 increases, which provides additional feedback and allows the player to fine-tune his sense of the position of the racquet head.

The use of the air foil to provide feedback to the player in the two situations depicted in FIGS. 5-8 and 9-12, and thereby to aid in the training of his tennis stroke, have been discussed. These are but two selected examples of the use of the air foil to provide useful feedback to the player. There are multiple other opportunities for the use of the air foil to provide feedback and to aid in the training of the player. In fact, in virtually every situation involving the racquet moving through the air, the air foil will provide tactile feedback to the player regarding the position of the air foil, and therefore of the racquet head. The uses of the air foil to aid in training of the player are thus limited primarily by the player's imagination.

Figure 13:
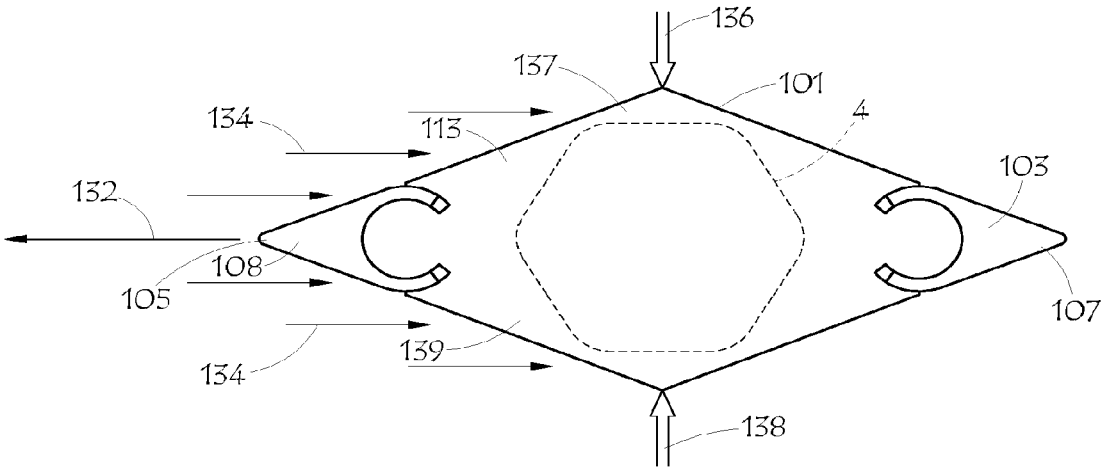
FIG. 13 is a cross sectional view of the air foil, showing forces thereon during a stroke with the flaps in neutral positions.
Figure 14:
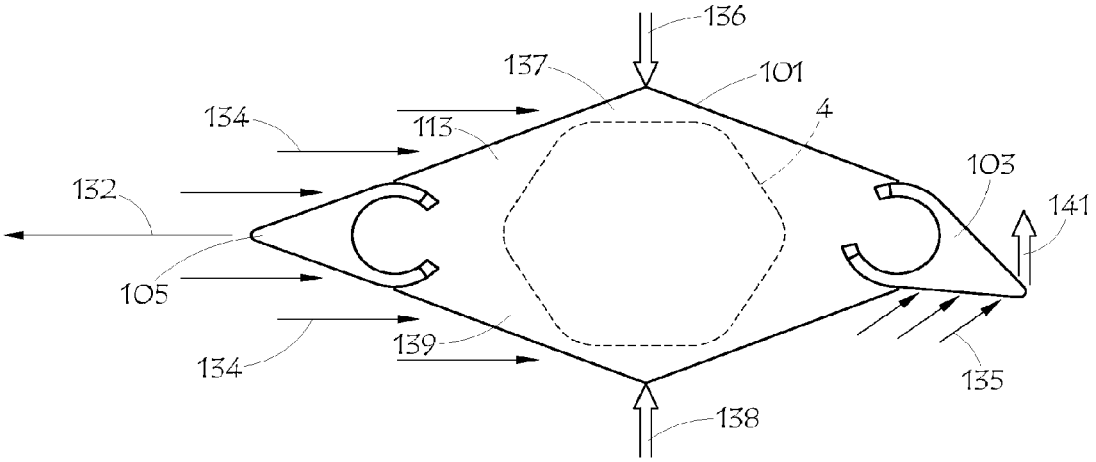
FIG. 14 is a cross sectional view of the air foil, showing forces during a stroke with one of the flaps deployed in a downward direction.
Figure 15:
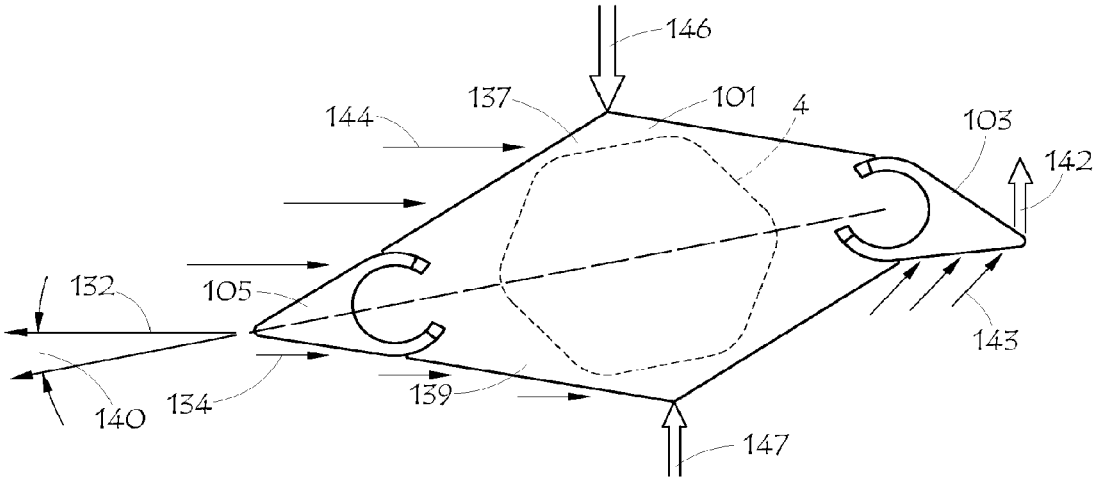
FIG. 15 is a cross sectional view of the air foil with one flap deployed, showing forces during a stroke when the angle of attack differs from the swing path.

Referring now to FIGS. 13-15, another embodiment of the air foil 101 is shown, which includes pivotably mounted flaps 103, 105 for altering the flow of air over the air foil. In FIG. 13, the flaps 103, 105 are shown in neutral positions 107, 108. With the flaps in these neutral positions, and the air foil 101 moving parallel to the ground as indicated by swing path 132, the air foil 101 operates in the same manner and is subject to the same forces as in the example cited in connection with FIGS. 5 and 6 above.

Still referring to FIG. 13, as the air foil 101 proceeds along the path 132 air resistance 134 occurs against the leading wing 113, creating a downward force 136 on the upper portion 137 of the wing, and an upward force 138 on the lower portion 139 of the wing 113. However, since the orientation of the air foil 101 and the racquet path 132 are both parallel to the ground, the downward force 136 and the upward force 138 are equal and thus cancel each other out. The player can learn to feel this equilibrium state, thus giving him useful feedback that his racquet position is in the desired position, and thereby aiding in his training.

Referring now to FIG. 14, the air foil 101 begins in the same orientation relative to the swing path 132 as depicted in FIG. 13. However, as also shown in FIG. 14, the rear flap 103 has been deployed in a downward direction. This causes air resistance 135 against the flap 103, thereby creating an upward force 141 to be added to the mix of forces depicted in FIG. 13, the original equilibrium state. Thus, the air foil 101 of FIG. 14 in this orientation relative to the swing path 132 is no longer in an equilibrium state, and will give the player feedback to that effect. Under these conditions, the racquet will naturally seek the equilibrium state of FIG. 15.

As shown in FIG. 15, in the equilibrium state the air foil 101 has tilted from parallel to the ground by an angle of attack 140, in a manner similar to that depicted in FIGS. 7 and 8. In this orientation, the air resistance 144 on the upper wing portion 137 creates a downward force 146, while the air resistance 145 on the lower wing portion 139 creates a lesser upward force 147. However, under equilibrium conditions the downward force 146 now exceeds the upward force 147 by an amount precisely equal to the upward force 142 created by the air resistance 143 on the downwardly deployed flap 103. Thus the air foil 101 of FIG. 15 has found an equilibrium state relative to the air resistance forces being applied to it. The player can once again learn to feel this condition of the racquet head and the air foil, and his training is enhanced by this feedback. This is but one example of the myriad ways in which the flaps 103, 105 may be deployed in order to give the player feedback on his stroke and thereby enhance his training.

This invention has been described in detail with reference to a particular embodiment thereof, but it will be understood that various other modifications can be effected within the spirit and scope of this invention.

The invention claimed is:

1. A training aid for use by a player with a tennis racquet having a handle, a throat, and a racquet head, comprising:

at least one wing having a proximal end in said throat, and extending therefrom and tapering down into a distal end;

wherein when the player makes a stroke with the racquet, air pressure on said wing creates forces which provide the player with feedback on the position of the racquet head during the stroke.

2. A training aid as claimed in claim 1, wherein the aid includes two wings extending in opposite directions from said throat.

3. A training aid as claimed in claim 2, wherein the aid is removably attached to said throat.

4. A training aid as claimed in claim 2, wherein said wings are in approximately the same plane as said racquet head.

5. A training aid as claimed in claim 2, further including:

a rotatable flap near the distal end of at least one of said wings, such that when said flap is rotated the air pressure on said flap during a stroke is altered, thereby changing the forces created on said flap and altering the feedback provided to said player.

6. A training aid as claimed in claim 2, wherein:

said aid is removably attached to said throat; and said wings are in approximately the same plane as said racquet head.

7. A training aid as claimed in claim 6, further including:

a rotatable flap near the distal end of at least one of said wings, such that when said flap is rotated the air pressure on said flap during a stroke is altered, thereby changing the forces created on said flap and altering the feedback provided to said player.

8. A method for training a player in making a tennis stroke comprising the steps of:

providing a racquet having a handle, a throat, and a racquet head and further including two wings extending in opposite directions from said throat; and wherein each wing has a proximal end in said throat and extending therefrom and tapering down into a distal end and wherein said wings are removably attached to said throat in approximately the same plane as said racquet head, said method further comprising:

making a stroke with the racquet which creates air pressure forces on the wing which provide the player with feedback on the position of the racquet head during the stroke.

* * * * *